United States Patent [19]

Sawada

[11] Patent Number: 4,780,580

[45] Date of Patent: Oct. 25, 1988

[54] SWITCH FOR MOTOR

[75] Inventor: Kenji Sawada, Furukawa, Japan

[73] Assignee: ALPS Electric Co. Ltd., Japan

[21] Appl. No.: 105,492

[22] Filed: Oct. 1, 1987

Related U.S. Application Data

[63] Continuation-in-part of Ser. No. 864,710, May 19, 1986, abandoned.

[30] Foreign Application Priority Data

May 17, 1985 [JP] Japan ..... 60-73134[U]

[51] Int. Cl.[4] ..... H01H 9/00

[52] U.S. Cl. ..... 200/68.2; 200/1 V; 200/339

[58] Field of Search ..... 200/1 V, 6 R, 6 B, 238, 200/239, 68.1, 68.3

[56] References Cited

U.S. PATENT DOCUMENTS

| | | | |
|---|---|---|---|
| 2,377,134 | 5/1945 | Dietrich | 200/68.2 |
| 3,350,521 | 10/1967 | Brown | 200/68.2 X |
| 3,694,598 | 9/1972 | Nishikawa et al. | 200/68.2 X |
| 3,944,768 | 3/1976 | Aryamane et al. | 200/68.2 X |
| 4,121,068 | 10/1978 | Peck | 200/68.2 |
| 4,168,405 | 9/1979 | Raab et al. | 200/1 V |
| 4,176,261 | 11/1979 | Epple | 200/1 V |
| 4,259,552 | 3/1981 | Swann | 200/6 R |
| 4,356,357 | 10/1982 | Fisher | 200/1 V X |
| 4,408,105 | 10/1983 | Tanaka | 200/68.2 |
| 4,654,487 | 3/1987 | Sawada | 200/1 V |

FOREIGN PATENT DOCUMENTS

| | | | |
|---|---|---|---|
| 647547 | 8/1962 | Canada | 200/68.2 |

*Primary Examiner*—Henry C. Recla
*Assistant Examiner*—Ernest G. Cusick
*Attorney, Agent, or Firm*—Guy W. Shoup; Paul J. Winters

[57] ABSTRACT

A switch adapted for an automotive power window comprises a housing, fixed contacts connected together by a crank-shaped connector member, barriers that hold the connector member therebetween, and connecting, fixed terminals disposed on the bottom of the wafer. When selected ones of energizing fixed terminals are connected together, the switch is adapted to be disposed around the driver's seat of an automobile. When the connecting member is omitted, the switch is adapted to be disposed around other passenger's seat.

2 Claims, 5 Drawing Sheets

SWITCH FOR MOTOR

This is a continuation application from application Ser. No. 864,710 filed May 19, 1986, now abandoned.

FIELD OF THE INVENTION

The present invention relates to a switch for a motor and, more particularly, to a switch for an automotive power window.

BACKGROUND OF THE INVENTION

A switch of one type is disposed around the driver's seat of an automobile, while other types of switches are disposed around other seats for controlling the power windows of an automobile. For example, as a safety consideration, the switch around the driver's seat may be used to drive a motor forward or in reverse for opening and closing a window, whereas those around the othe seats may drive the motor in only one direction to close a window. Generally, the switch around the driver's seat is required to have its terminals for energization connected together, so that the switch can control a forward driving circuit and a reverse driving circuit, while the terminals of switches around the other seats should be disconnected from each other so that the switch can control only one driving circuit. The simplest countermeasure heretofore taken to form such circuitry has been to modify the switch configuration. When this conventional method is employed, it is necessary that switches of different configurations be manufactured independently for use with the power windows of an automobile.

SUMMARY OF THE INVENTION

It is an object of the present invention to provide a switch for a motor, the switch being free of the foregoing problems with the prior art techniques.

It is a more specific object of the invention to provide a switch which can be manufactured as either one of two types simply by connecting or not connecting fixed terminals disposed on the outside of a casing, without changing the structure of the body of the switch.

These objects are achieved in accordance with the teachings of the invention by a switch comprising: a casing; fixed contacts used for switching purposes, the contacts being fixed within the casing; a crank-shaped connector member that connects together the fixed contacts; barriers that hold the connector member therebetween, the barriers acting also as stoppers for the connector member; and connecting, fixed terminals disposed on the reverse side of the bottom of the casing, selected ones of the energizing fixed terminals being connected together.

DESCRIPTION OF THE PREFERRED EMBODIMENT

Figure 1:
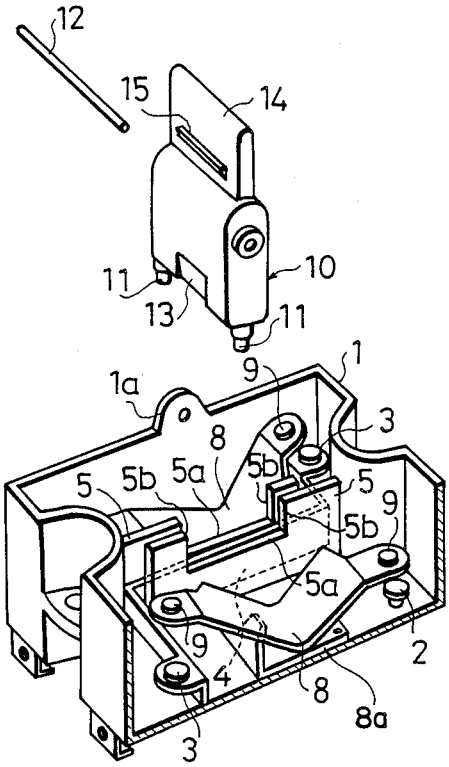
FIG. 1 is an exploded perspective view of a motor switch according to the invention, and in which the casing is partially omitted.
Figure 2:
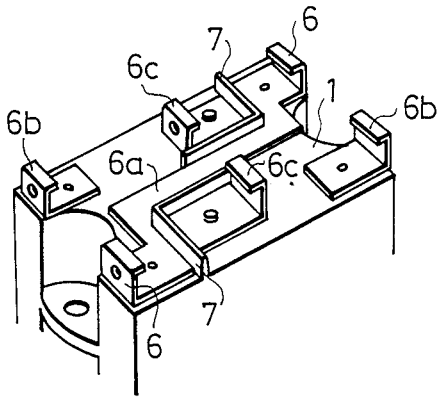
FIG. 2 is a perspective view of the casing shown in FIG. 1, as viewed from above the bottom of the casing.
Figure 3:
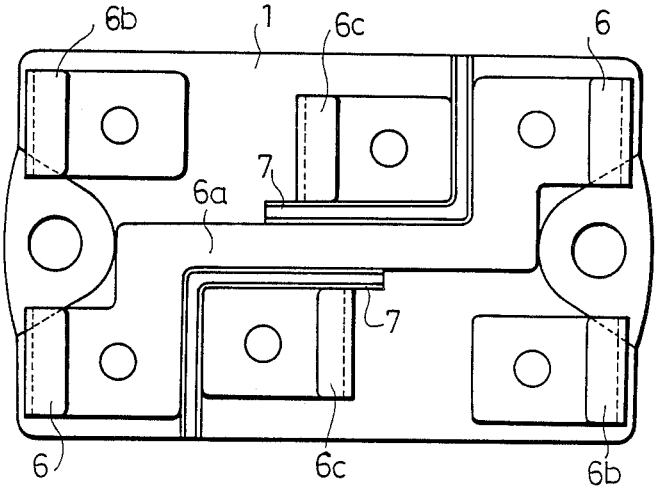
FIG. 3 is a bottom view of the wafer shown in FIGS. 1 and 2.
Figure 4:
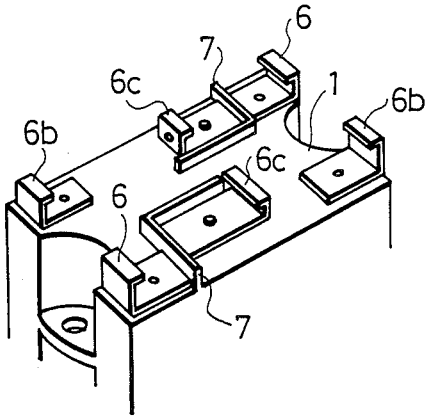
FIG. 4 is a perspective view of the casing shown in FIGS. 1–3, as viewed from above the bottom of the casing, and in which its connecting member has been removed.
Figure 5:
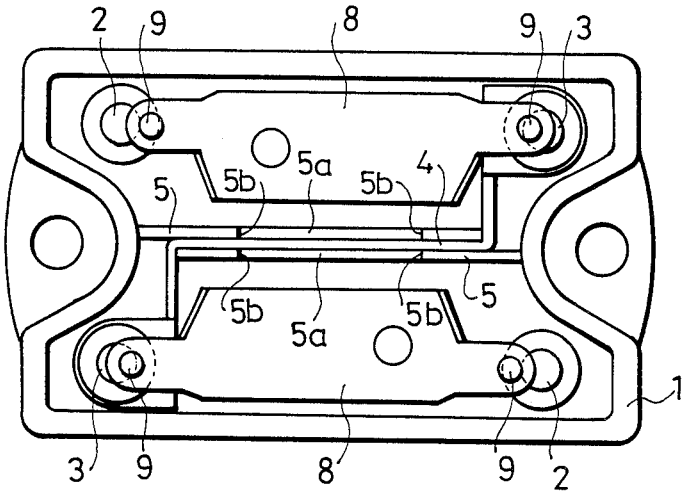
FIG. 5 is a plan view of the casing shown in FIGS. 1–4, and in which the operation member has been removed.

Referring to the drawings, there is shown a switch which is manufactured in accordance with the invention. This switch has a casing 1 having an opening on its upper side. Fixed contacts 2 for energization are rigidly secured to the bottom of the casing 1. Also, fixed contacts 3 for switching are firmly mounted to the bottom of the casing 1. The contacts 2 are disposed in a diametrically opposite relation with respect to the center of the bottom. Also, the contacts 3 are disposed in a diametrically opposite relation with respect to the center of the bottom. The fixed contacts 3 are connected together by a crank-shaped connector member 4. This connector member 4 has a straight plate portion, and barriers 5 which extend upwardly from the casing 1 hold the plate portion therebetween. A recess 5a is formed at each center of the upper fringes of the barriers 5. An operation member (described later) extends over the recesses 5*a*. Stopper portions 5*b* are formed in neighboring relation to the recesses 5*a*.

Connecting, fixed terminals 6, 6*b*, 6*c* are fixed to the reverse side of the bottom of the casing 1. The front ends of these terminals are bent to prevent lead wires from breaking. The terminals 6 which are connected with the energizing fixed contacts 2 are connected together by a connector member 6*a*. The terminals 6*b* are connected to fixed contacts 3 through the bottom wall of the wafer 1. The terminals 6*c* are connected to the movable element 8 through a connecting piece 8*a*. Thus, a switch adapted to be disposed around the driver's seat of an automobile is formed. L-shaped barriers 7 are formed so as to be surrounded by the fixed terminals 6, 6*b*, 6*c*. When the terminals 6, 6*b*, 6*c* are mounted, the barriers 7 act to prevent these terminals from rotating. If the barriers 7 are made longer, they will be able to stop all the fixed terminals 6, 6*b*, 6*c* from turning.

If the connecting member 6*a* connecting the fixed terminals 6 is omitted from the reverse side of the bottom of the casing 1, the switch can be disposed around another seat, such as the passenger's seat. The fixed terminals 6 are connected with the energizing, fixed contacts 2.

Substantially V-shaped movable elements 8 are mounted outside the barriers 5 extending upright inside the casing 1. Movable contacts 9 are firmly fixed to both ends of each movable element 8. The movable elements 8 are actuated by an operation member 10 which is provided with driving rods 11 at both sides of the lower end. Each rod 11 is biased by a compressed spring 18. The front end of each rod 11 is spherical in shape. The operation member 10 is so disposed as to extend over the recesses 5*a* of the barriers 5. A shaft 12 extends through the oepration member 10, and is mounted to support portions 1*a* protruding from each center of the upper lateral fringes of the casing 1 so that the member 10 may rotate about the shaft 12.

Figure 6:
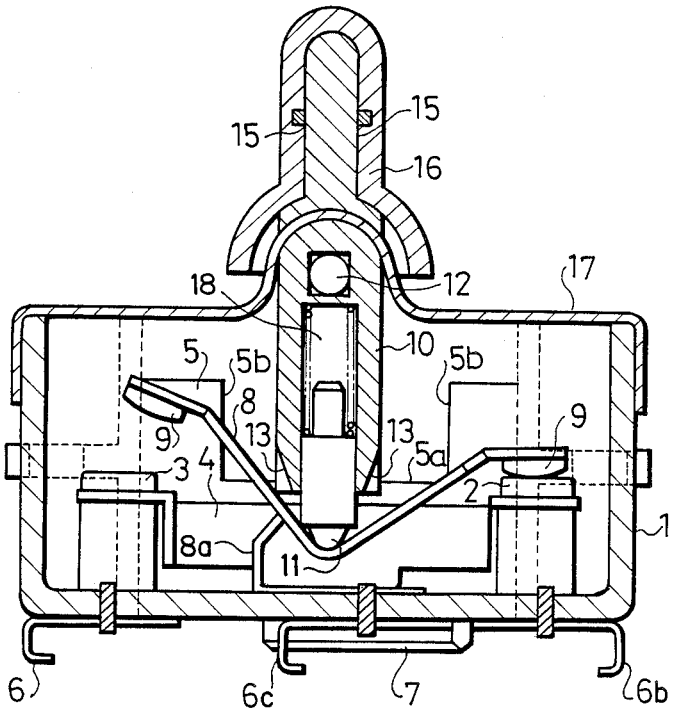
FIG. 6 is a cross-sectional view of the switch shown in FIG. 1, and in which it has been assembled.

The operation member 10 is further provided with tapering abutting portions 13 at the center of the lower surface of the member. As the operation member 10 is tilted, either one of the abutting portions 13 abuts against corresponding ones of the stopper portions 5*b*, whereby the operation member 10 can no longer move. A knob 14 extends upwardly from, and is formed integrally with, the operation member 10. The knob 14 is provided with anchoring protrusions 15 on its both sides. A cap 16 (see FIG. 6) can be detachably mounted on the knob 14 with a press fit. A waterproof casing 17 is made from rubber.

An example will now be described to illustrate how the described switch can be used to control the power windows of an automobile for safety. For the driver's seat, the switch has a wire from a DC power source connected to one terminal 6, the other terminal 6 also being connected to the power source through the inside connector 4, a ground wire connected to one terminal **6*b*, the other terminal 6*b* being connected to ground through the external connector 6*a*, and wires to respective sides of a reversing motor connected to terminals 6*c* which are each connected to a respective movable element 8. Thus, when the knob is thrown in one direction, one movable element 8 is in contact with a contact 2 connected to one ground terminal 6*b* and the other movable element 8 is in contact with a contact 3 connected to a power terminal 6, thereby driving the motor in one direction. When the knob is thrown in the other direction, the movable elements are in contact with a power terminal and a ground terminal in reverse configuration, thereby driving the motor in reverse. For the other seats, the connector 6*a*** on the outside of the housing is omitted. Thus, the knob can actuate the motor in only one direction and not the reverse.

As described above, in accordance with the invention, barriers extending upright within a wafer hold a connector member therebetween, the barriers also acting to stop an operation member. Therefore, the switch can be manufactured either as a switch adapted to be disposed around the driver's seat or as a switch adapted to be disposed around other passenger's seat, by simply connecting or not connecting fixed terminals on the reverse side of the bottom of the casing, without modifying the body of the switch.

What is claimed is:

1. A changeover switch for a reversible motor, comprising:

an insulated housing having a bottom portion, side walls, and an upper portion provided with an actuator member pivotably mounted therethrough;

a pair of movable contact elements arranged side by side in said housing, wherein the two movable elements are movable by the pivotable actuator member toward one side of said housing to contact respective associated fixed contacts and toward the other side of said housing to contact other respective associated fixed contacts;

a first pair of fixed contacts associated with a first one of said pair of movable elements, and a second pair of fixed contacts associated with the second of said pair of movable elements, said fixed contacts being arranged spaced apart from each other in respective parts of said bottom portion of said housing;

a crank-shaped inside connector member that electrically connects one of said first pair of fixed contacts on one side of said housing with an opposite one of said second pair of fixed contacts on the other side of said housing;

insulative barrier walls arranged in said housing to hold said inside connector member therebetween and having portions which act as stoppers for the movement of the actuator member; and a first pair of fixed terminals disposed on an external side of said bottom portion of said housing which are electrically connected to respective ones of said first pair of fixed contacts, a second pair of fixed terminals disposed on said external side which are electrically connected to respective ones of said second pair of fixed contacts, and a third pair of fixed terminals disposed on said external side which are electrically connected to respective ones of said movable elements, wherein one of said first pair of fixed terminals, which is electrically connected to the other of said first pair of fixed contacts, can be electrically connected to an opposite one of said second pair of fixed terminals, which is electrically conected to one of said second pair of fixed contacts, by an external connector member in order to configure the switch for controlling the motor in forward and reverse directions, and said external connector member can be omitted in order to configure the switch for controlling the motor in only one direction.

2. A switch for motor as set forth in claim 1, wherein barriers that prevent the fixed terminals from rotating when these fixed terminals are mounted are formed between the fixed terminals.

* * * * *

UNITED STATES PATENT AND TRADEMARK OFFICE

CERTIFICATE OF CORRECTION

PATENT NO. : 4,780,580

DATED : October 25, 1988

INVENTOR(S) : Kenji Sawada

It is certified that error appears in the above-identified patent and that said Letters Patent is hereby corrected as shown below:

On the Title Page, Item [54], should read

--Connection Structure for Fixed Contacts and Fixed Terminals of Motor Changeover Switch-- col. 4, line 37 "conected" should be --connected--

Signed and Sealed this

Twenty-first Day of March, 1989

*Attest:*

DONALD J. QUIGG

*Attesting Officer*

*Commissioner of Patents and Trademarks*